US006507287B1

(12) United States Patent
Barnett

(10) Patent No.: US 6,507,287 B1
(45) Date of Patent: Jan. 14, 2003

(54) EMERGENCY RESPONDER ALERTING MARKER AND METHOD

(76) Inventor: James Earl Barnett, 804 Scott Dr., Robinson, IL (US) 62454

( * ) Notice: Subject to any disclaimer, the term of this patent is extended or adjusted under 35 U.S.C. 154(b) by 0 days.

(21) Appl. No.: 09/531,873

(22) Filed: Mar. 21, 2000

(51) Int. Cl.[7] ..... G08G 1/095

(52) U.S. Cl. ..... 340/908; 340/815.4; 340/815.83; 116/63 R; 116/63 P

(58) Field of Search ..... 340/908, 908.1, 340/907, 815.4, 815.47, 815.83; 116/63 R, 63 P, 63 T

(56) References Cited

U.S. PATENT DOCUMENTS

| | | | | |
|---|---|---|---|---|
| 418,938 | A | | 1/1890 | Bogusch |
| 930,509 | A | | 8/1909 | Warfield |
| 1,115,021 | A | | 10/1914 | Pummill |
| 2,864,191 | A | | 12/1958 | Hagen |
| 3,625,177 | A | | 12/1971 | Miller |
| 3,846,935 | A | | 11/1974 | Wagner |
| 3,880,406 | A | | 4/1975 | Stehle et al. |
| 3,934,541 | A | * | 1/1976 | May et al. ..... 116/63 P |
| 4,005,537 | A | | 2/1977 | vonCamber et al. |
| 4,300,300 | A | | 11/1981 | Neuland et al. |
| 4,547,761 | A | | 10/1985 | Jones |
| 4,796,369 | A | | 1/1989 | Haman |
| 4,901,461 | A | | 2/1990 | Edwards et al. |
| 4,993,058 | A | | 2/1991 | McMinn et al. |
| 5,009,541 | A | | 4/1991 | Thurston |
| 5,458,434 | A | | 10/1995 | Bent et al. |
| 5,621,379 | A | | 4/1997 | Collins |
| 5,710,543 | A | | 1/1998 | Moore |

* cited by examiner

*Primary Examiner*—Daryl Pope

(57) ABSTRACT

An Emergency Responder Alerting Marker which is manufactured of molded plastic, which is highly visible due to size and color, and which can be strategically placed so as to attract the attention of approaching Emergency Responders. The apparatus is portable, reducible in size, and is not reliant upon the utility of electricity.

23 Claims, 4 Drawing Sheets

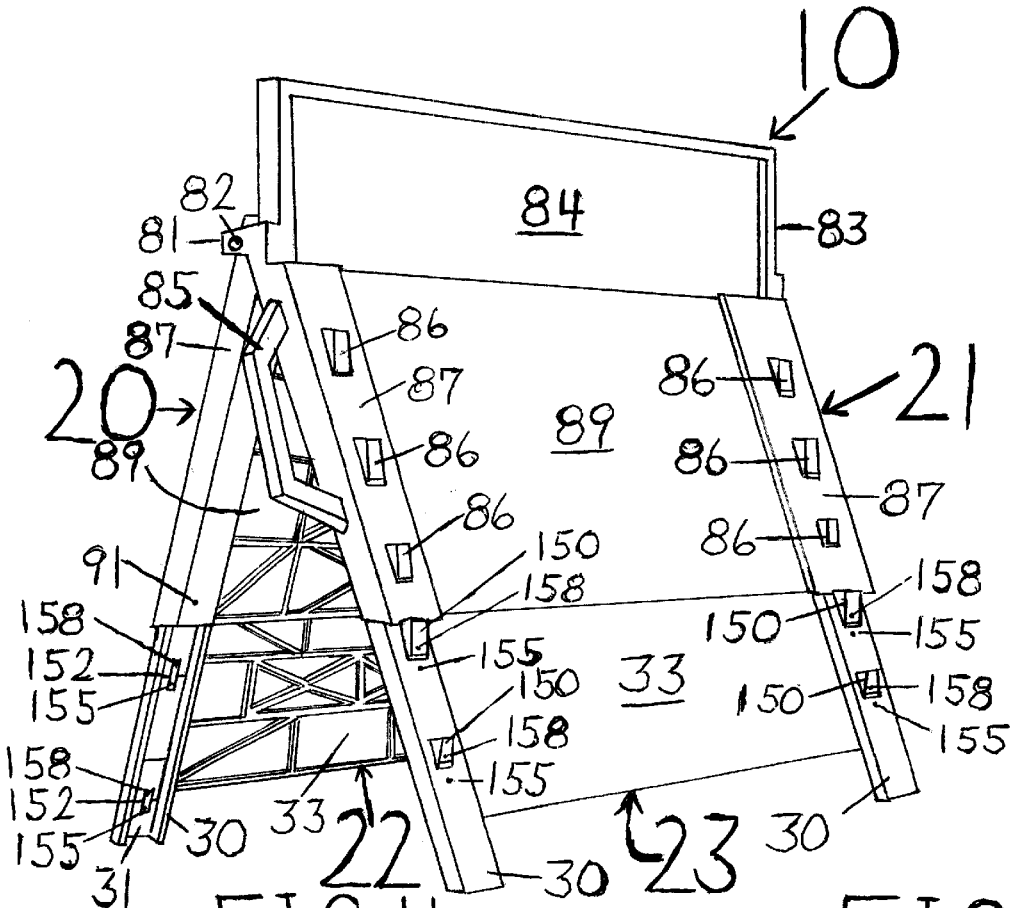
FIG. 4
FIG. 1
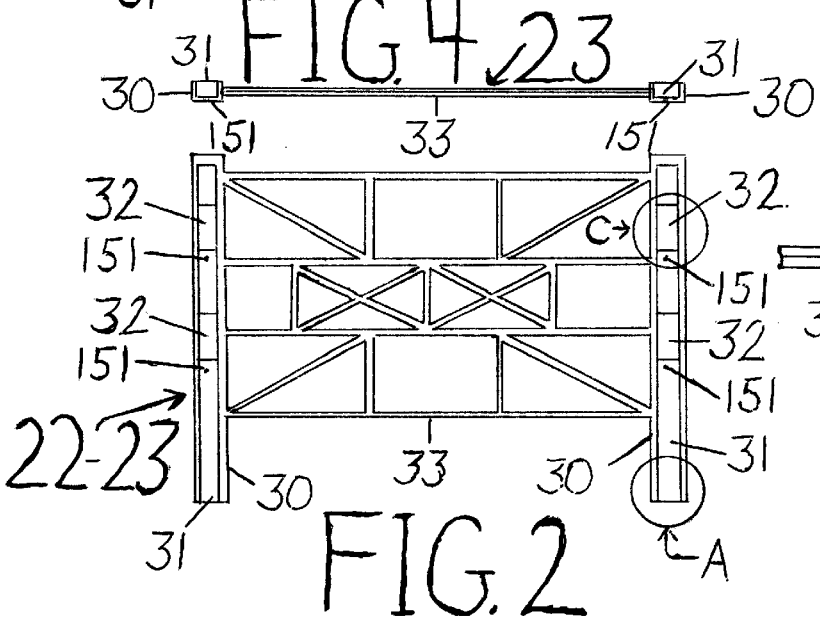
FIG. 2
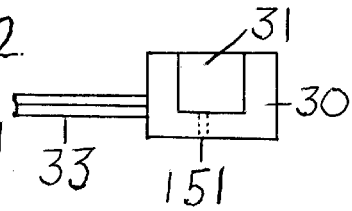
FIG. 3

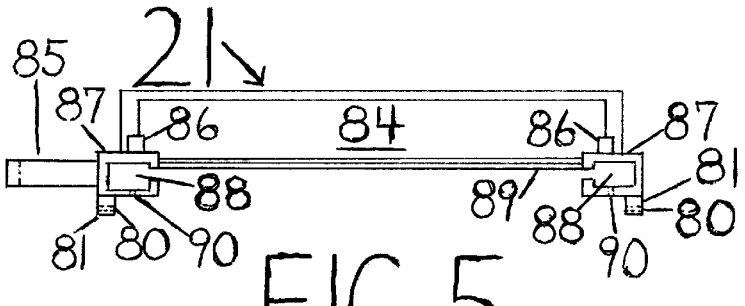
FIG. 5
FIG. 6
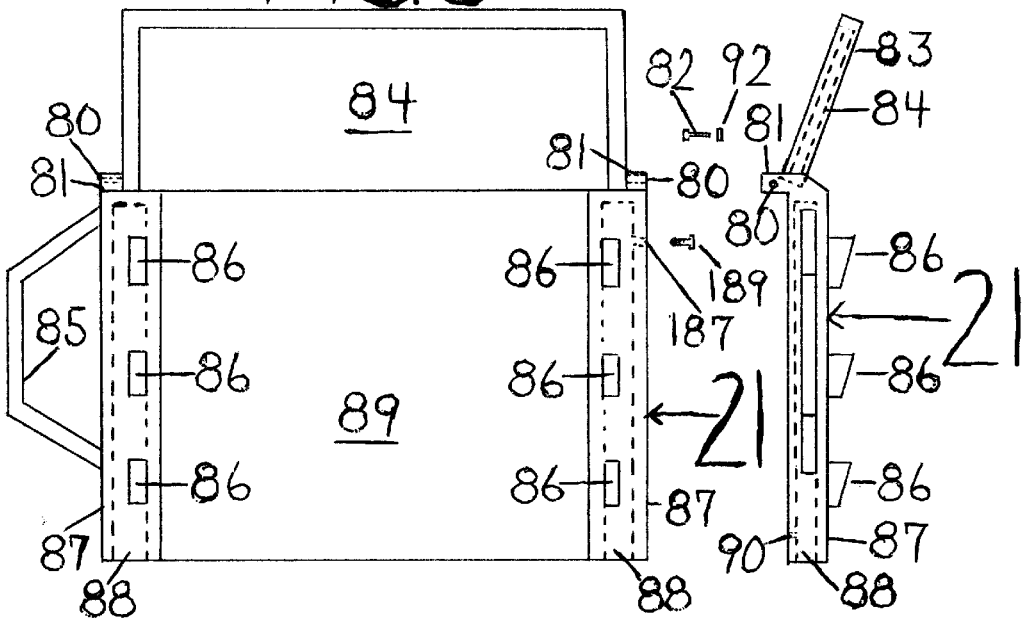
FIG. 7
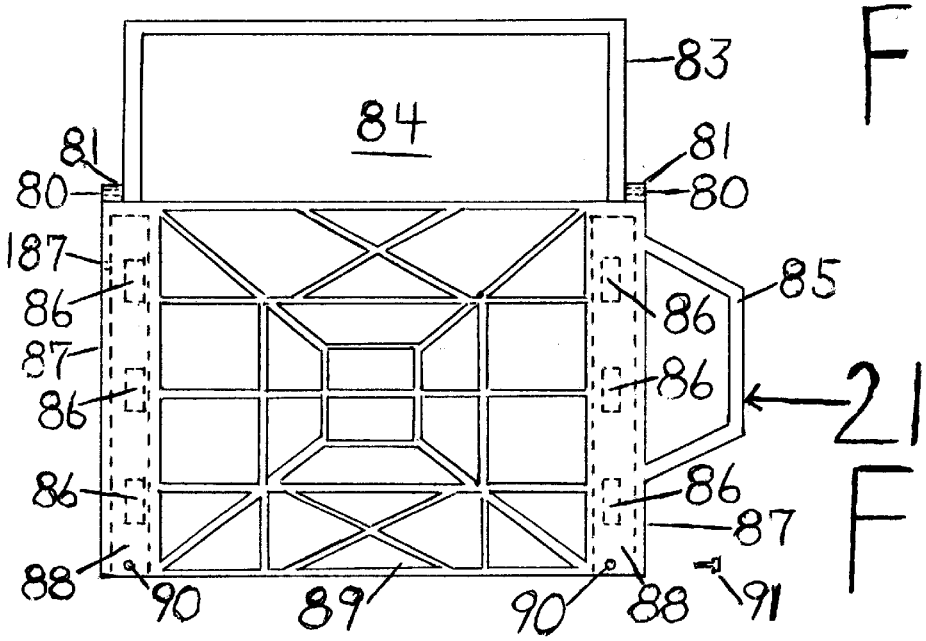
FIG. 8

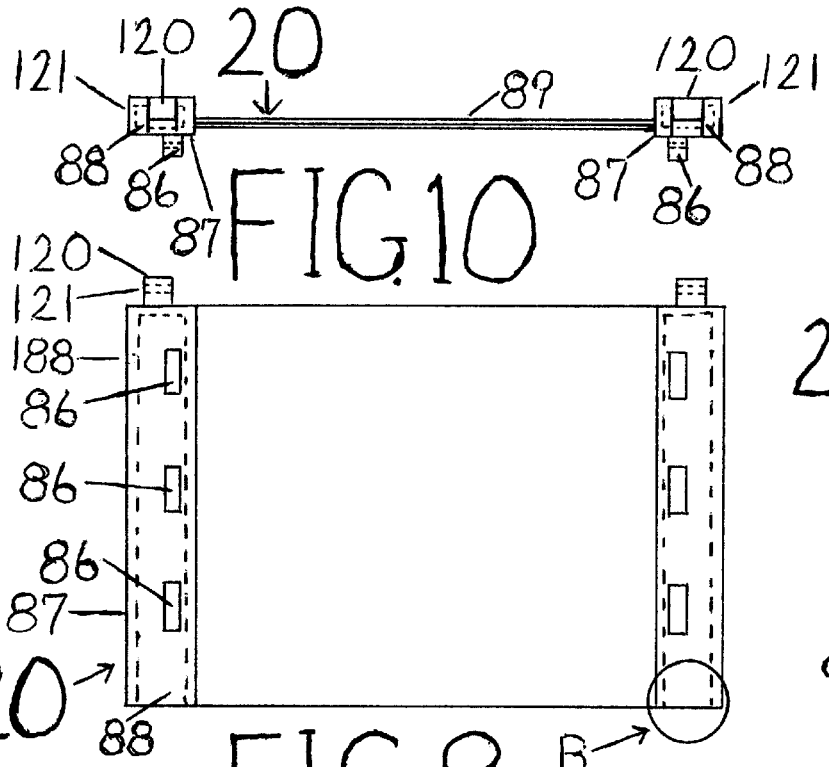
FIG. 10
FIG. 9
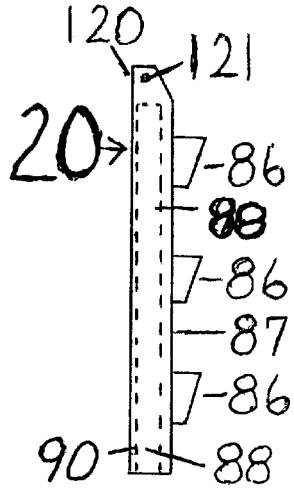
FIG. 11
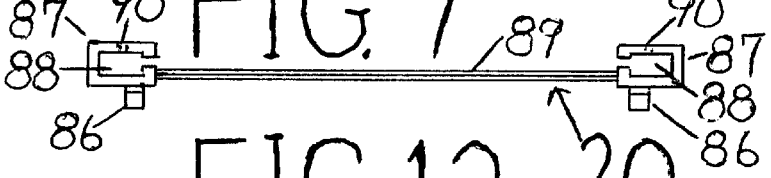
FIG. 12
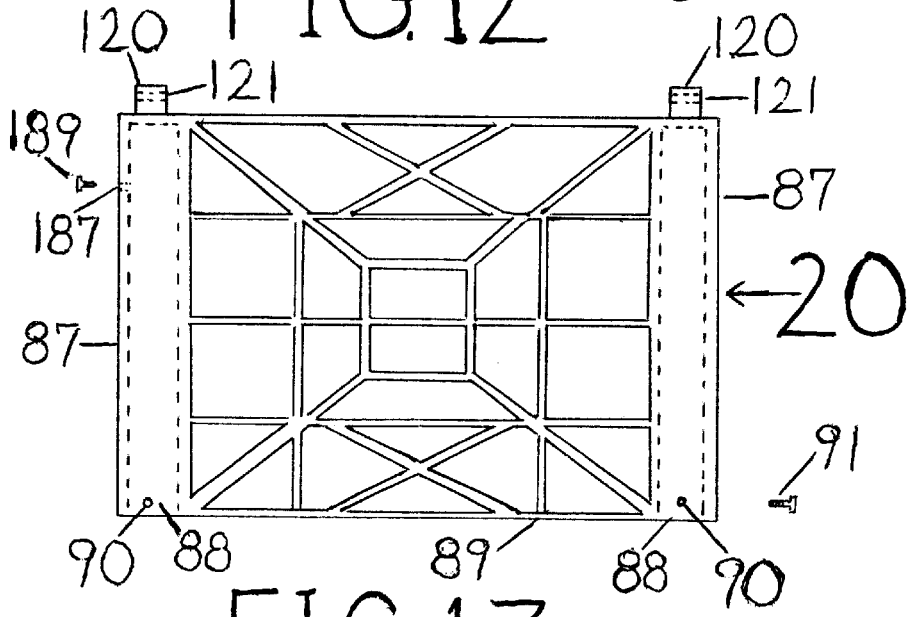
FIG. 13

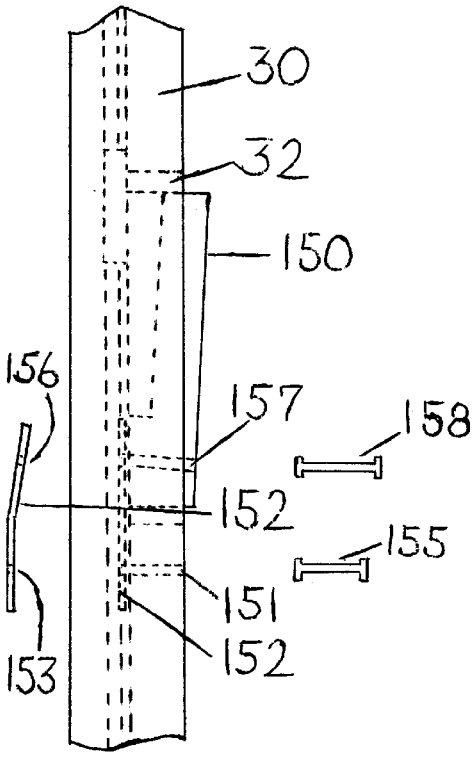
FIG.14
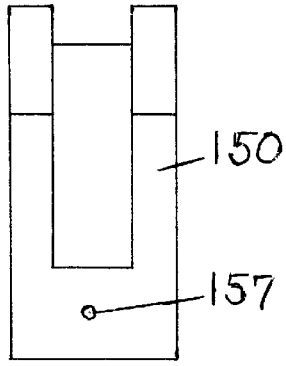
FIG.15
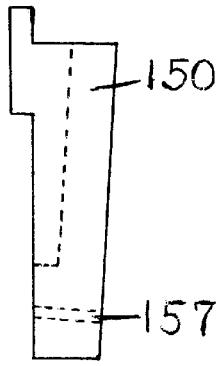
FIG.16
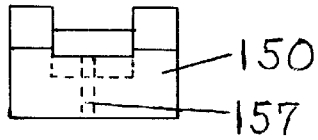
FIG.17
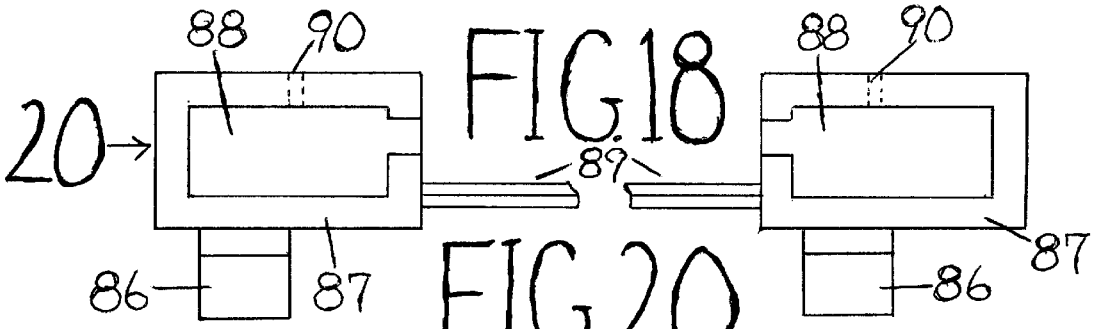
FIG.18
FIG.19
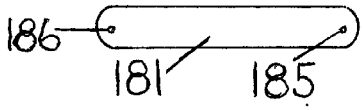
FIG.20
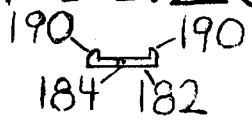
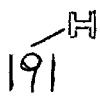
FIG.21
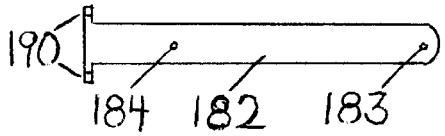

EMERGENCY RESPONDER ALERTING MARKER AND METHOD

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

The present invention generally relates to signaling apparatuses which in this instance relates specifically to a marker which serves to alert emergency responders as to the location of an emergency.

In the last several years, American culture has seen a shift in emergency response services. Thirty years ago, ambulance services provided a somewhat short response time to a call in order that an individual might be transported to a hospital for medical services. At the present time, almost every community is served by emergency response personnel who are qualified medical technicians. Before patients are transported to a medical facility, they are evaluated and stabilized by the responding technicians. Such on site care has not led to a reduced concern regarding response time (the actual time between the call and the arrival of the responders to the incident). Rather, an intensified need for reducing response time is deemed necessary since life saving procedures can be provided early in the onset of a medical emergency. When the response time of trained professionals to the site of a emergency is reduced, there is a greater chance that an injured party will survive, that time of recovery will be reduced, or that subsequent medical costs may be reduced.

Response time, therefore, whether by Emergency Medical Technicians, Rescue Squads, Police, or Fire personnel, if it can be reduced, is highly beneficial. Various signaling devices have been developed in the past. Many of these devices employ flashing or continuous lighting as is disclosed by Jones in U.S. Pat. No. 4,547,761. Others employed fixtures to attract the attention of passers by as disclosed by Moore in U.S. Pat. No. 5,710,543. Some devices were even triggered by the dialing of a predetermined emergency phone number as is disclosed by Collins in U.S. Pat. No. 5,621,377. While each has its appeal, various problems do exist with such devices. A reliance upon electricity and electrical devices invites potential failure. Any broken link in the chain such as power failure, dead battery, failed bulb, defective wiring, failed buzzer, etc. reduces the device's effectiveness. These devices also required a fixed location. These fixed locations due to ordinance restriction, placement of vehicles on the street, the growth in trees or bushes over time may prevent the signaling device from being clearly seen. These devices are also costly. The price alone may be the chief reason that more households have not enjoyed the benefits offered by these devices.

Consequently, a need exists for improvements in means and method of alerting emergency response personnel as to the location of an emergency which have no reliance upon electricity, which can be placed at a point for maximum visibility, and which are not costly to residents.

BRIEF SUMMARY OF THE INVENTION

The present invention provides an apparatus and method for alerting emergency responders as to the location of an emergency that are designed to satisfy the needs as mentioned above. Signaling the location of an emergency for responders is accomplished through the placement of a marker. Placement of a marker eliminates the reliance upon electricity. This marker is large enough in size and appropriately colored and embossed with reflective material so as to be easily seen by approaching responders. Since the apparatus employs an A-framed design, it can be placed reasonably in almost any location. Since the apparatus is portable, the resident is able to choose the most effective location of the marker in order that it might readily be seen by responders. The placement of this marker is facilitated by the fact that the marker can be reduced in size and is composed of lightweight material. Being able to reduce the size of the marker also facilitates the use of the apparatus. Such an apparatus can be manufactured at a low cost. Consequently, nearly every household would be able to employ the apparatus and method for alerting responders as has been provided.

BRIEF DESCRIPTION OF THE SEVERAL VIEWS OF THE DRAWINGS

The present invention may be clearly understood from an examination of the following drawings as are referenced in the Detailed Description of the Invention.

FIG. 1 is a view in perspective of the Emergency Responder Alerting Apparatus.

FIG. 2 is a rear elevation view of one of the two identical lower panel units.

FIG. 3 is an enlarged section view of one of the two identical lower panel units as illustrated within FIG. 2 looking from the direction of arrow A.

FIG. 4 is a top view of one of the two identical lower panel units.

FIG. 5 is a front elevation view of the upper panel unit which includes a handle and a surface upon which an address may be affixed.

FIG. 6 is a bottom view of the upper panel unit which includes a handle and a surface upon which an address may be affixed.

FIG. 7 is a side view of the upper panel unit which includes a handle and a surface upon which an address may be affixed.

FIG. 8 is a rear elevation view of the upper panel unit which includes a handle and a surface upon which an address may be affixed.

FIG. 9 is a front elevation view of the remaining (2nd) upper panel unit.

FIG. 10 is a top view of the remaining (2nd) upper panel unit.

FIG. 11 is a side view of the remaining (2nd) upper panel unit.

FIG. 12 is a bottom view of the remaining (2nd) upper panel unit.

FIG. 13 is a rear elevation view of the remaining (2nd) upper panel unit.

FIG. 14 is an enlarged sectional view of the frames (from the circled area) from the lower panel unit as illustrated within FIG. 2. This view illustrates the spring actuated locking mechanism looking from the direction of Arrow C.

FIG. 15 is an enlarged rear view of a spring actuated locking mechanism.

FIG. 16 is an enlarged side view of a spring actuated locking mechanism.

FIG. 17 is an enlarged top view of a spring actuated locking mechanism.

FIG. 18 is an enlarged sectional view of the frames (from the circled area) from the upper panel unit as illustrated within FIG. 9 looking from the direction of arrow B.

FIG. 19 is a side elevation view of one arm of the frame locking assembly.

FIG. 20 is a front elevation view of one arm of the frame locking assembly.

FIG. 21 is a side elevation view of one arm as illustrated in FIG. 20.

DETAILED DESCRIPTION OF THE INVENTION

FIG. 1 of the drawings illustrates in perspective an Emergency Responder Alerting Apparatus 10. The Emergency Responder Alerting Apparatus 10 in its preferred embodiment is manufactured with injection molded plastic which is solid, substantial, and which is manufactured of a highly visible color. The Emergency Responder Alerting Apparatus 10 is comprised of four (4) frame supported and reinforced panel sections 20, 21, 22, and 23 (FIG. 1). 20 and 21 are upper panel units (FIG. 1). 22 and 23 are lower panel units (FIG. 1). When the Emergency Responder Alerting Apparatus 10 is lifted vertically above the surface upon which it rests, the lower panel units 22 and 23 extend from within the upper panel units 20 and 21 (FIG. 1) and lock into place providing a considerable solid surface 89 and 33 (FIG. 1). When the deployed Emergency Responder Alerting Apparatus 10 is placed by an individual at an appropriate location of choice by allowing the Emergency Responder Alerting Apparatus 10 to stand in a triangular (A-Framed) manner (FIG. 1), the Emergency Responder Alerting Apparatus 10 can be easily seen and recognized by Emergency Responders. Prior alerting devices have been established in pre-determined positions and/or have relied upon the utility of electricity to alert responders. The Emergency Responder Alerting Apparatus 10 allows for strategic placement in varying conditions and relies upon the dependability of visibility due to the highly visible color and significant overall size.

The upper panel units 20 (FIG. 9) and 21 (FIG. 5) differ due to their manufacture. The upper panel 21 (FIG. 7) includes offset extrusions 81, which are molded or drilled in such a manner so as to yield a hole 80 through which a bolt 82 passes (FIG. 5, FIG. 6, FIG. 7, FIG. 8). The upper panel unit 21 also includes an angular variance 83 (FIG. 7) from the plane of the upper panel unit 21 which provides a surface perpendicular to the horizon after the Emergency Responder Alerting Apparatus 10 (FIG. 1) has been deployed upon which an address may be affixed as well as reflective material. The upper panel unit 21 also includes a handle 85 (FIG. 1, FIG. 5, FIG. 6, FIG. 7, FIG. 8) which may be used to carry the Emergency Responder Alerting Apparatus 10 (FIG. 1).

Upper panel unit 20 varies in manufacture from upper panel unit 21 in that the upper panel unit 20 (FIG. 9 and FIG. 11) includes extrusions 120 which are molded and drilled in such a manner so as to yield a hole 121 through which a bolt 82 passes (FIG. 7).

The upper panel units 20 and 21 (FIG. 1), while they differ as illustrated above, are also similar in some respects. The upper panel units 20 (FIG. 11) and 21 (FIG. 7) both include molded extrusions 86 on the outer facing surface of the frames 87 of the panel units. When the Emergency Responder Alerting Apparatus 10 (FIG. 1) is deployed, the molded extrusions 86 yield a surface which is perpendicular to the horizon. Reflective material may then be applied to the outer facing surface of the molded extrusion 86. The upper panel units 20 (FIG. 9) and 21 (FIG. 5) also include frames 87 (FIG. 1) which are molded in such a manner so as to provide internal cavities 88 (FIG. 6, FIG. 10, and FIG. 12) which allow the frames 30 of the lower panel units 22 and 23 (FIG. 1) to slide into the frames 87 of the upper panel units 20 and 21 (FIG. 1) which extend nearly the entire length of the frame 87 (FIG. 5 and FIG. 9). Another similarity in the construction of the upper panel units 20 (FIG. 8) and 21 (FIG. 13) is a reinforced panel section 89 between frames 87. The upper panel units 20 and 21 (FIG. 1) are manufactured as solid units comprised of frames 87, panels 89, and various extrusions as outlined above. The frames 87 include molded or drilled holes 90 (FIG. 8 and FIG. 13) into which screws 91 (FIG. 8 and FIG. 13) may be inserted to act as blocking mechanisms to prevent the lower panel units from falling away from the upper panel units when the Emergency Responder Alerting Apparatus 10 (FIG 1) is being carried or deployed.

The lower panel units 22 and 23 as illustrated in FIG. 1 are identical in manufacture as is illustrated in FIG. 2, FIG. 3, and FIG. 4. The lower panel units 22 and 23 include frames 30 molded in a manner which yields a groove 31 (FIG. 2 and FIG. 4) on the interfacing surfaces which have evenly dispersed rectangular openings 32 (FIG. 2) as well as molded or drilled holes 151 (FIG. 2, FIG. 3, and FIG. 14). These openings 32 allow for placement of spring actuated locking mechanisms 150 (FIG. 1, FIG. 14, FIG. 15, FIG. 16, and FIG. 17). The spring actuated locking mechanisms 150 are molded plastic which include a molded or drilled hole 157 (FIG. 14, FIG. 15, FIG. 16, and FIG. 17). A metal strip spring 152 (FIG. 1 and FIG. 14) has machined holes 153 and 156. The frame 30 is then attached to the metal strip spring by means of passing a rivet 155 (FIG. 14) through holes 153 and 151 (FIG. 1 and FIG. 14). The spring actuated locking mechanism 150 is also riveted (158) through holes 156 and 157 (FIG. 14, FIG. 15, FIG. 16, and FIG. 17) thus securing the spring actuated locking mechanism 150 onto the frames 30 (FIG. 1 and FIG. 14). Reflective material may be added to the outer facing surface of the spring actuated locking mechanisms 150 (FIG. 1). The lower panel units 22 and 23 (FIG. 1, FIG. 2 and FIG. 4) include reinforced panel sections 33 between frames 30.

The lower panel units 22 and 23 (FIG. 1) are placed within the internal cavity 88 (FIG. 12) of the upper panel units 20 and 21 (FIG. 1) and screws 91 (FIG. 13) are inserted to prevent the lower units 22 and 23 from dropping out of the upper panel units 20 and 21 (FIG. 1). The joined upper and lower panel units 20 and 22 (FIG. 1) are then attached to the joined upper and lower panel units 21 and 23 (FIG.1) by bolts 82 (FIG. 1 and FIG. 7) passing through the molded extrusions 120 (FIG. 11) of the upper panel unit 20 (FIG. 1, FIG. 10, FIG. 11, and FIG. 13) and the molded extrusions 81 of the upper panel unit 21 (FIG. 5, FIG. 6, FIG. 7, and FIG. 8). Nuts 92 (FIG. 7) are attached to the bolts 82 (FIG. 7).

The frame locking assembly is comprised of two metal plates 181 and 182 (FIG. 19 and FIG. 21). The plates 181 and 182 are riveted (191) together at holes 184 and 185 (FIG. 19 and FIG. 21). The frame locking assembly is then secured to the upper panel unit 21 (FIG. 5) by placing a screw 189 through hole 183 (FIG. 21) and driving the screw into hole 187 of frame 87 (FIG. 5). The frame locking mechanism is then secured to the upper panel unit 20 (FIG. 9) by placing a screw 189 through hole 186 (FIG. 19) and driving the screw into hole 188 of frame 87 (FIG. 9). When the Emergency Responder Alerting Apparatus 10 (FIG. 1) is opened into an A-framed stance, plate 181 (FIG. 19) interlocks with plate 182 (FIG. 21) by action of the raised edges 190 of plate 182 (FIG. 20 and FIG. 21). The Emergency Responder Alerting Apparatus 10 (FIG. 1) is thereby locked into its deployed stance as illustrated in FIG. 1.

I claim:

1. An apparatus for alerting responders as to the location of an emergency, comprising:

(a) a frame supported and reinforced upper panel unit with molded extrusions upon which reflective material is applied, and said frames of panel unit are molded in such a manner that the said frames of upper panel unit may receive the frames of the lower panel unit into the frame of said upper panel unit and which said frames include blocking devices;

(b) a frame supported and reinforced upper panel unit with molded extrusions upon which reflective material is applied and which includes an angular variance from the plane of said panel which provides, when apparatus is deployed, a framed surface perpendicular to the horizon whereupon an address and reflective material may be affixed, and said frames of panel unit are molded in such a manner that the said frames of upper panel unit may receive the frames of the lower panel unit into the frame of said upper panel unit and which said frames include blocking devices;

(c) two upper panel units conjoin to form an A-framed structure;

(d) two frame supported and reinforced panels which comprise the lower panel units the frames of which are molded in such a manner so as to include a groove on the interfacing surfaces extending nearly the entire length of said frames which are molded so as to allow for placement of spring actuated locking mechanisms upon which reflective material is applied.

2. An apparatus for alerting responders as to the location of an emergency, which comprises:

a) means for attracting the visual recognition of responders without a reliance upon the utility of electricity;

b) means for providing discriminatory placement of apparatus in the clearest filed of vision for responders;

c) means for facilitating transport of the apparatus; and d) means for facilitating storage of the apparatus, wherein said means for attracting the visual recognition of responders without a reliance upon the utility of electricity includes deployment of a solid surface of highly visible color, and wherein said solid surface of highly visible color includes multiple frame supported and reinforced panel sections, wherein said multiple frame supported and reinforced panel sections include:

two frame supported and reinforced panel sections which comprise upper panel units of said apparatus; and two frame supported and reinforced panel sections which comprise lower panel units of said apparatus;

wherein said upper panel units include:

molded extrusions on the outer facing surface of the frame of the panel units which when said apparatus is deployed, yield a surface which strikes a plane perpendicular to the horizon;

said molded extrusions with surfaces perpendicular to the horizon have applied thereon reflective material.

3. A responder alerting apparatus as recited in claim 2, wherein: said frames of lower panel units include:

a groove on the interfacing surface;

said groove has interspersed rectangular openings;

said groove extends nearly the entire length of said frames.

4. A responder alerting apparatus as recited in claim 3, wherein: said interspersed rectangular openings in the grooves of panel frames allow for placement of spring actuated locking mechanisms.

5. A responder alerting apparatus as recited in claim 4, wherein: said spring actuated locking mechanisms, when said apparatus is deployed, yield a surface which strikes a plane perpendicular to the horizon.

6. A responder alerting apparatus as recited in claim 5, wherein: said spring actuated locking mechanisms with surfaces perpendicular to the horizon have applied thereon reflective material.

7. A responder alerting apparatus as recited in claim 2, wherein one of said upper panel units includes an angular variance from the plane of said panel which provides, when said apparatus is deployed, a framed surface perpendicular to the horizon.

8. A responder alerting apparatus as recited in claim 7, wherein: said framed surface perpendicular to the horizon provides a surface upon which an address may be affixed.

9. A responder alerting apparatus as recited in claim 8, wherein: said framed surface has reflective material applied to said framed surfaced.

10. A responder alerting apparatus as recited in claim 2, wherein: said means for providing discriminatory placement of said apparatus in the clearest field of vision for responders includes two frame supported and reinforced panels comprising the upper panel units which are conjoined to form an A-framed structure.

11. A responder alerting apparatus as recited in claim 10, wherein: said A-framed structure when placed in an open stance allows said apparatus to stand in a location deemed most effective so as to attract the attention of responders.

12. A responder alerting apparatus as recited in claim 2, wherein: said means for facilitating transport of apparatus includes a handle molded onto the side of said frame of one upper panel unit.

13. A responder alerting apparatus as recited in claim 2, wherein: said means for facilitating transport of apparatus includes two frame supported and reinforced panels comprising the upper panel units whose frames are molded in such a manner so as to allow said frames of the upper panel units to receive the frames of the lower panel units into the frames of the said upper panel units.

14. A responder alerting apparatus as recited in claim 13, wherein: said frames of lower panel units are molded in such a manner so as to include a groove on the interfacing surfaces extending nearly the entire length of said frames.

15. A responder alerting apparatus as recited in claim 14, wherein: said grooves of panel frames are molded so as to allow for placement of spring actuated locking mechanisms.

16. A responder alerting apparatus as recited in claim 15, wherein: said spring actuated locking mechanisms lock the lower panel units into place below the upper panel units when said apparatus is deployed.

17. A responder alerting apparatus as recited in claim 2, wherein: said means for facilitating storage of said apparatus includes two frame supported and reinforced panels comprising the upper panel units which are conjoined to form an A-framed structure and into which said upper panel unit frames receive the frames of frame supported and reinforced panels which comprise the lower panel units.

18. A responder alerting apparatus as recited in claim 17, wherein: said upper panel units have a blocking device inserted into the frames thereof after lower panel units have been inserted thus preventing the lower panel units from dropping out of the upper panel units.

19. A method for alerting responders as to the location of an emergency, including the apparatus of claim 1, comprising the steps of:

(a) attracting the visual recognition of responders without a reliance upon the utility of electricity;

(b) providing discriminatory placement of an apparatus in the clearest field of vision for responders; and (c) facilitating transport of said apparatus.

20. A responder alerting method as recited in claim 19, wherein: said attracting the visual recognition of responders without a reliance upon the utility of electricity includes: placement of an apparatus of highly visible color.

21. A responder alerting method as recited in claim 19, wherein: said providing discriminatory placement of an apparatus in the clearest field of vision for responders includes: a non-fixed, easily mobile apparatus.

22. A responder alerting method as recited in claim 19 wherein: said facilitating transport of an apparatus includes: an apparatus with retractable panels.

23. A method for alerting responders as to the location of an emergency, including the apparatus of claim 1, comprising the steps of:

(a) placement of an apparatus of highly visible color for attracting the visual recognition of responders without a reliance upon the utility of electricity;

(b) placement of a non-fixed, easily mobile apparatus in the clearest field of vision for responders; and (c) retraction of panels of an apparatus facilitating transport of apparatus.

* * * * *